United States Patent [19]

Baker et al.

[11] 4,077,414

[45] Mar. 7, 1978

[54] SMOKING ARTICLES

[75] Inventors: Richard Roland Baker, Southampton; Sydney James Green, Peaslake; Keith Douglas Kilburn, Southampton, all of England

[73] Assignee: Brown & Williamson Tobacco Corporation, Louisville, Ky.

[21] Appl. No.: 647,771

[22] Filed: Jan. 9, 1976

[30] Foreign Application Priority Data

Jan. 9, 1975 United Kingdom ..... 989/75

[51] Int. Cl.[2] ..... A24D 1/02

[52] U.S. Cl. ..... 131/8 R; 131/15 B

[58] Field of Search ..... 131/15 R, 15 A, 15 B, 131/15 C, 8 R, 9, 10 R

[56] References Cited

U.S. PATENT DOCUMENTS

| | | | |
|---|---|---|---|
| 2,217,527 | 10/1940 | Roon | 131/12 |
| 2,981,261 | 4/1961 | Rupert | 131/15 B |
| 3,046,994 | 7/1962 | Schur | 131/10 |
| 3,324,861 | 6/1967 | Gaisman | 131/10.3 |
| 3,370,593 | 2/1968 | Owaki | 131/15 R |
| 3,526,904 | 9/1970 | Tamol | 131/15 B |
| 3,547,131 | 12/1970 | Dock | 131/9 |
| 3,590,825 | 7/1971 | Davis | 131/10 |
| 3,664,350 | 5/1972 | Wall | 131/10 A |
| 3,667,479 | 6/1972 | Sanford et al. | 131/15 B |
| 3,805,799 | 4/1974 | Stewart et al. | 131/9;15 B X |
| 3,911,932 | 10/1975 | Houck et al. | 131/15 B |

FOREIGN PATENT DOCUMENTS

| | | | |
|---|---|---|---|
| 680,735 | 5/1938 | Germany | 131/15 B |
| 2,220,165 | 11/1972 | Germany | 131/15 B |
| 1,632,242 | 12/1970 | Germany | 131/15 B |
| 1,795,662 | 11/1958 | Germany | 111/15 B |

*Primary Examiner*—Robert W. Michell
*Assistant Examiner*—V. Millin
*Attorney, Agent, or Firm*—William J. Mason

[57] ABSTRACT

A smoking article has a paper wrapper provided with alternate bands, encircling the article, of low and higher porosity, the low porosity being within the range of from 0 to 100 and the higher porosity in the range of from 150 to 2000, while the average porosity is, suitably, in the range of from 50 to 500.

Advantageously, the ratio of the width of the bands of low porosity to that of the bands of higher porosity is at least 1 to 1. The width of the bands of low porosity may be within the range of from 1.0 to 3.0 mm and that of the bands of higher porosity within the range of from 0.1 to 3.0 mm.

6 Claims, 2 Drawing Figures

SMOKING ARTICLES

This invention concerns improvements relating to smoking articles, especially but not exclusively cigarettes.

It is known to treat cigarette paper with substances which, for example, effect an increase in the burn rate of the cigarette, give a white ash or improve the flavour of the cigarette. Generally the paper is coated over the whole surface, but such substances may be applied in selected areas along the length of the cigarette. It is likewise known to treat cigarette paper with a salt solution, such as an aqueous solution of borax and common salt, to produce a reduction in the burn rate or to extinguish the cigarette. However, in order to obtain combustion, it is then necessary for the cigarette paper wrapper to have a certain degree of porosity. Usually the cigarette will burn fairly rapidly when not puffed, which is not desirable.

It is an object of the invention to provide means for advantageously controlling the burn rate of a cigarette, for instance, and/or for increasing the puff number.

Figure 1:
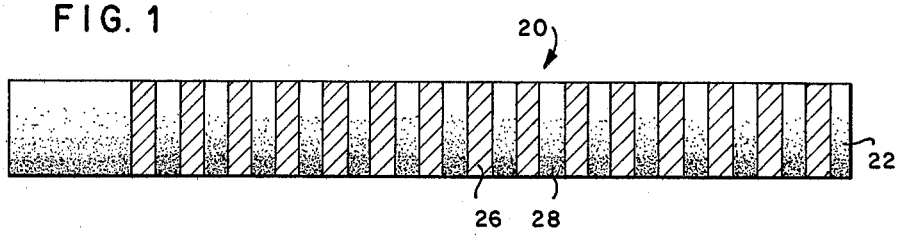
Figure 2:
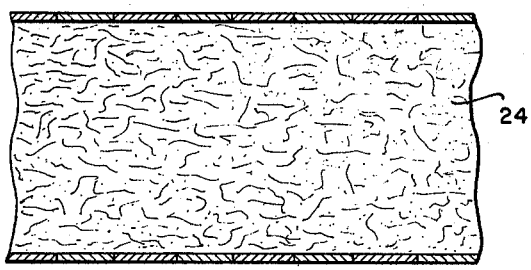

In the attached drawings,

FIG. 1 is an enlarged side elevation view of a cigarette with bands of enlarged width, and FIG. 2 is a further enlarged partial longitudinal sectional view thereof.

According to the invention, as shown in FIGS. 1 and 2, a smoking article 20 has a wrapper of paper 22 provided with alternate bands, encircling the article 24, of low porosity 26 and higher porosity 28. Suitably the low porosity is within the range of from 0 to 100 and the higher porosity in the range of from 150 to 2000 (in each case in the units hereinafter referred to). The ratio of the low porosity to the higher porosity is preferably less than 0.3. Both kinds of bands may be porous. However, the porosity of the low-porosity bands may be 0 or substantially so. It is preferably within the range of 0 to 50. Suitably the average porosity of the wrapper is within the range of from 50 to 500, preferably 80 to 325. All the porosities herein referred to have been determined with a Wiggins Teape paper-permeability apparatus and are in units of $cm^3min^{-1}(10cm^2)^{-1}$ (10cm water gauge)$^{-1}$.

The puff number of a cigarette, for example, will depend on the proportion of the area of the wrapper occupied by the bands of low porosity and by the bands of higher porosity, that is upon the ratio of the widths thereof. Advantageously the ratio of the width of the bands of low porosity to that of the bands of higher porosity is 1 to 1 or greater than 1 to 1. Suitably, the width of the bands of low porosity is within the range of from 1.0 to 3.0 mm, for example 2.0 mm. Suitably also the width of the bands of higher porosity is within the range of 0.1 to 3.0 mm, provided that the width-ratio limitation previously stated is observed.

The alternate bands should occupy the whole, or substantially the whole, length of the wrapper around the tobacco rod and should substantially encircle the wrapper around the tobacco rod of the smoking article, that is around at least 75% of the circumference. Preferably, however, the bands encircle the whole circumference.

The alternate bands of low and higher porosity can be obtained in various ways: With a paper of inherently low porosity, bands of higher porosity may be obtained by treating the paper in those bands to open it, and increase the porosity, by perforation or embossment. A dandy roll or a marker press, as used in the paper making industry may be employed for producing the bands of different porosity. With a paper of inherently high porosity, the bands of low porosity may be produced by treating the paper in those bands to reduce its porosity. This may be achieved by treatment with a substance which blocks or fills pores of the paper or forms films across interfibre gaps thereof. Thus a gel-forming substance may be applied to the paper in the said bands by a painting, printing or other coating technique. Particularly suitable substances are those which form gels in water. Preferred substances are gelatine, alginates, methyl cellulose, methylethyl cellulose and gums. Water-insoluble substances such as lacquers and varnishes may also be used in an organic solvent. Bands of low porosity may also be produced by the technique used for paper "glazing".

A further method which, in effect, combines steps of the two methods referred to above, is to coat one side of the paper with a solution of a gel-forming subtance to reduce its porosity in controlled manner to zero or other required low value and then to produce the bands of higher porosity by perforating or embossing the paper in those bands.

Ways of carrying the invention into effect are illustrated by the following Examples:

In the Examples, the smoulder rates were obtained for the cigarette smouldering in a draught-free environment under static, non-puffing, conditions and are given in length of tobacco rod burnt per minute. The average puff numbers are the average of at least eight cigarettes smoked to a butt length of 23 mm, under the standard conditions of one puff per minute of 35 ml volume and 2 seconds duration. As far as possible, test and control papers were matched for porosity and combustibility, and cigarettes for weight and pressure drop. All cigarettes were 70 mm long and of 25 mm circumference. The tobacco used in each case was a flue-cured Virginia tobacco.

EXAMPLE 1

A cigarette wrapper of paper having a porosity of 35 (in the aforesaid units) was perforated electrostatically in known manner to form alternate bands of low and high porosities with widths of $x = 2.0$ mm and $y = 0.2$ mm respectively. The perforations were of 50 - 100 micron diameter. The porosity in the perforated bands was 2000 and the average porosity 242.

A cigarette of flue-cured Virgina tobacco wrapped in this paper, with the bands encircling the complete circumference of the cigarette, gave a smoulder rate of 3.2 mm/min. and 9.7 puffs under the above-stated conditions.

A control cigarette of the same tobacco wrapped in a conventional paper having a comparable average porosity of 258 gave a smoulder rate of 4.2 mm/min. and only 7.5 puffs.

EXAMPLE 2

A paper wrapper having a porosity of 100 was perforated electrostatically to form bands of low and high porosity with widths of $x = y = 2$ mm, the perforations being of 50 - 100 micron diameter. The porosity in the perforated bands was 550 and the average porosity 325. A cigarette tobacco wrapped in this paper, with the bands encircling the cigarette gave a smoulder rate of 4.1 mm/min. and 8.4 puffs.

A cigarette of the same tobacco wrapped in a conventional paper of comparable average porosity of 340 gave a smoulder rate of 5.1 mm/min. and 6.8 puffs.

EXAMPLE 3

A paper wrapper having a porosity of 37 was embossed in known manner to form bands of low and high porosity with widths of $x = y = 2$ mm. The porosity in the embossed regions was 239 and the average porosity 138.

A cigarette of tobacco wrapped in this paper, with the bands encircling the cigarette, gave a smoulder rate of 3.6 mm/min. and 9.3 puffs.

A cigarette wrapped in a conventional paper of comparable average porosity of 132 gave a smoulder rate of 3.9 mm/min. and 8.3 puffs.

EXAMPLE 4

A gelatine solution was prepared in the following manner:

900 g of de-ionised gelatine and 500 g of citric acid were added, with stirring, to 2.3 l of water. The gelatine was allowed to swell at room temperature for 30 minutes. The mixture was heated until the gelatine dissolved and 3 l of near-boiling methanol was added slowly. Heating and stirring were continued and a further 12 l of near-boiling methanol was added, followed by 4 l of cold acetone. The solution was allowed to cool to room temperature.

Analysis of the solution gave the following composition:

| Substance | % w/w of Substance From Recipe | From Analysis | Analytical Method |
|---|---|---|---|
| Gelatine | 4.8 | 4.4 | Based on total nitrogen assay and assuming gelatine contains 17% N. |
| Citric Acid | 2.7 | 2.7 | Acid/base titration |
| Methanol | 63 | 62 | GC(Gas chromatography) |
| Acetone | 17 | 20 | GC |
| Water | 12 | 14 | GC and near infrared analysis |

The suspended gelatine particles in the solution were approximately 2 to 4 microns in diameter.

A paper wrapper with a porosity of 320 was coated uniformly over its whole surface with the gelatine solution to give a coating thickness of 0.9 g/m$^2$. The coating was applied by a solvent-coating machine (a Dixon No.164 Solvent Coater with a Meyer Rod as used in the paper-printing industry). The porosity of the paper was thus reduced to 15. The coated paper was embossed in known manner to form bands with widths $x = y = 2$ mm, the porosity in the $y$ bands being 165 and the average porosity 90. A cigarette of tobacco wrapped in this paper, with the bands encircling the cigarette and the gelatine coating on the inside of the wrapper, gave a smoulder rate of less than 2.2 mm/min. and 9.5 puffs. For a cigarette similarly wrapped in this paper but, with the coating on the outside of the wrapper, the smoulder rate was 2.9 mm/min. and the puff number 8.8. This compares with 4.2 mm/min. and 7.9 puffs for a cigarette wrapped in a conventional paper of comparable average porosity of 90.

EXAMPLE 5

A paper wrapper with a porosity of 370 was coated with a 5% aqueous solution of gelatine in the form of bands with widths $x = y = 2$ mm. The coating thickness was 1.0 g/m$^2$, so that the porosity in the $x$ bands was zero and the average porosity 173.

A cigarette of tobacco wrapped in this paper with the bands encircling the cigarette and the gelatine coating on the outside of the wrapper, gave a smoulder rate of 4.4 mm/min. and 7.9 puffs. This compares with 4.9 mm/min. and 7.2 puffs for a cigarette wrapped in a paper having a comparable average porosity of 170.

EXAMPLE 6

A paper wrapper with a porosity of 360 was coated with a 5% aqueous solution of sodium alginate in the form of bands with widths $x = y = 2$ mm. The coating thickness in the $x$ bands was 1.2 g/m$^2$ and the porosity was zero, the average porosity being 167. A cigarette of tobacco wrapped in this wrapper gave a smoulder rate of 3.0 mm/min. and 8.9 puffs.

EXAMPLE 7

A paper wrapper with a porosity of 360 was coated with a 5% aqueous solution of methyl cellulose to form bands with widths $x = y = 2$ mm. The coating thickness in the $x$ regions was 1.0 g/m$^2$ and the porosity was zero, the average porosity being 177. On smoking a cigarette wrapped in this paper, 8.1 puffs were obtained and a smoulder rate of 4.5 mm/min.

EXAMPLE 8

A paper wrapper with a porosity of 360 was coated with a 5% solution of shellac-based varnish in acetone to form bands with widths $x = y = 2$ mm. The coating thickness in the $x$ bands was 2.8 g/m$^2$, giving zero porosity. The average porosity was 148. A cigarette wrapped in this paper gave a smoulder rate of 3.6 mm/min. and 8.8 puffs.

EXAMPLE 9

A paper wrapper with a porosity of 360 was coated with a 5% aqueous solution of gelatine in bands with widths $x = y = 1$ mm. The coating thickness was 1.0 g/m$^2$ in the $x$ bands, giving zero porosity, the average porosity being 154. A cigarette wrapped in this paper gave a smoulder rate of 44.8 mm/min. and 7.7 puffs.

EXAMPLE 10

A wrapper with a porosity of 360 was coated with the same solution as in Example 9, but the widths were $x = y = 3$ mm, giving an average porosity of 160. A cigarette wrapped in this paper gave a smoulder rate of 4.8 mm/min. and 7.5 puffs.

For a comparable control cigarette for Examples 6 to 10, reference may be made to Example 5.

EXAMPLE 11

A wrapper was coated as in Example 9 but with widths $x = 2$ mm and $y = 1$ mm, giving an average porosity of 120. A cigarette wrapped in this paper gave a smoulder rate of 4.3 mm/min. and 7.7 puffs.

A control cigarette wrapped in paper of porosity 100 gave a smoulder rate of 4.7 mm/min. and 7.1 puffs.

EXAMPLE 12

A wrapper with a porosity of 360 was coated as in Example 9, but with band widths $x = 1$ mm and $y = 2$ mm, the average porosity being 204. A cigarette wrapped in this paper gave a smoulder rate of 4.8 mm/min. and only 7.3 puffs. This was similar to the smoulder rate of 4.9 mm/min. and 7.0 puffs given by a control cigarette wrapped in conventional wrapper paper of comparable porosity of 207. This indicates that the ratio $x/y$ of the widths of the bands of low porosity to those of high porosity should preferably be greater than unity if the smoulder rate is to be materially reduced and the number of puffs increased.

Comparison of Examples 5, 9, 10, 11 and 12 indicates that the most effective values with respect to band width are $x = 2.0$ mm and $x/y$ not less than 1.

EXAMPLE 13

A paper wrapper of porosity 345 was coated with bands of the gelatine solution produced as described in Example 4, but using a gravure roller, as used in the printing industry, on the solvent-coating machine. The coating thickness was 2.0 g/m$^2$ and the band widths were $x = 2\frac{1}{2}$ mm and $y = 1\frac{1}{2}$ mm. The porosity in the $x$ bands was zero and the average porosity was 80. A cigarette was wrapped with this paper, the coating being on the inside. This cigarette had a smoulder rate of 3.0 mm/min. and gave 9.0 puffs.

A cigarette wrapped in this paper, but with the coating on the outside, gave a smoulder rate of 3.2 mm/min. and 9.6 puffs. A control cigarette wrapped in conventional paper of comparable average porosity of 85 gave a smoulder rate of 4.4 mm/min. and only 7.5 puffs.

We claim:

1. A smoking article with a reduced smoldering rate having a wrapper of paper provided with a series of narrow, encircling bands of low paper porosity alternated along the length of the article with bands of higher paper porosity, said low porosity bands being from 1.0 to 3.0 mm in width and having a paper porosity within the range of 0 to 100 and said higher porosity bands being from 0.1 to 3.0 mm in width and having a paper porosity within the range from 150 to 2,000 in order to be able to control the burn rate and increase the puff number.

2. A smoking article according to claim 1, wherein the average porosity of the wrapper is in the range of from 50 to 500.

3. A smoking article according to claim 1, wherein the paper of the wrapper is inherently of low porosity and the bands of higher porosity are bands produced by perforating or embossing the paper.

4. A smoking article according to claim 1, wherein the paper is inherently of high porosity and the bands of low porosity are bands produced by treating the paper to reduce its porosity in those bands.

5. A smoking article according to claim 1, wherein the bands of low porosity are bands produced by coating the paper in those bands with a gel-forming substance.

6. A smoking article according to claim 1, wherein the paper is paper coated over its surface with a gel-forming substance to reduce its porosity to the value required in the bands of low porosity and the bands of higher porosity are bands produced by perforating or embossing the coated paper in the latter bands.

* * * * *

UNITED STATES PATENT AND TRADEMARK OFFICE

CERTIFICATE OF CORRECTION

PATENT NO. : 4,077,414

DATED : March 7, 1978

INVENTOR(S) : RICHARD R. BAKER, ET AL.

It is certified that error appears in the above-identified patent and that said Letters Patent are hereby corrected as shown below:

Column 4, Line 45, change "44.8 mm/min." to --4.8 mm/min.--.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*